United States Patent [19]

Sawaragi et al.

[11] Patent Number: 5,021,215

[45] Date of Patent: Jun. 4, 1991

[54] HIGH-STRENGTH, HEAT-RESISTANT STEEL WITH IMPROVED FORMABILITY AND METHOD THEREOF

[75] Inventors: Yoshiatsu Sawaragi, Nishinomiya; Nobuyuki Maruyama, Amagasaki, both of Japan

[73] Assignee: Sumitomo Metal Industries, Ltd., Osaka, Japan

[21] Appl. No.: 472,165

[22] Filed: Jan. 30, 1990

[30] Foreign Application Priority Data

Jan. 30, 1989 [JP] Japan ..... 1-22032

[51] Int. Cl.[5] ..... C22C 38/44; C22C 38/48; C22C 38/50

[52] U.S. Cl. ..... 420/584.1; 420/44; 420/46; 420/47; 420/48; 420/52; 420/53; 420/54; 420/55; 420/452; 420/453; 148/327; 148/442; 148/427

[58] Field of Search ..... 420/584.1, 48, 46, 44, 420/47, 52, 53, 54, 55, 452, 453; 148/327, 442, 427

[56] References Cited

U.S. PATENT DOCUMENTS

| | | | |
|---|---|---|---|
| 4,530,720 | 7/1985 | Moroishi et al. | 420/584 |
| 4,671,929 | 6/1987 | Kajimura et al. | 420/584 |
| 4,842,823 | 6/1989 | Sawaragi et al. | 420/584 |

FOREIGN PATENT DOCUMENTS

| | | | |
|---|---|---|---|
| 2255388 | 7/1975 | France . | |
| 2483467 | 12/1981 | France . | |
| 53-133524 | 11/1978 | Japan . | |
| 56-163244 | 12/1981 | Japan | 420/584 |
| 993613 | 6/1965 | United Kingdom . | |
| 1013240 | 12/1965 | United Kingdom . | |
| 1049379 | 11/1966 | United Kingdom . | |
| 1413934 | 11/1975 | United Kingdom . | |
| 2138446 | 10/1984 | United Kingdom . | |

*Primary Examiner*—Deborah Yee

*Attorney, Agent, or Firm*—Burns, Doane, Swecker & Mathis

[57] ABSTRACT

A high-strength, heat-resistant steel with improved formability is disclosed, which consists essentially of, by weight %:

| | |
|---|---|
| C: 0.05–0.30%, | Si: not greater than 3.0%, |
| Mn: not greater than 10%, | Cr: 15–35%, |
| Ni: 15–50%, | Mg: 0.001–0.02%, |
| B: 0–0.01%, | Zr: 0–0.10%, |
| Ti: 0–1.0%, | Nb: 0–2.0%, |
| Al: 0–1.0%, and | |
| Mo: 0–3.0%, | W: 0–6.0%, |
| (Mo + ½ W = 3.0% or less) | |

a balance of Fe and incidental impurities, of the impurities, oxygen and nitrogen being restricted to 50 ppm or less and 200 ppm or less, respectively, and the austenite grain size number being restricted to No. 4 or coarser.

27 Claims, 3 Drawing Sheets

HIGH-STRENGTH, HEAT-RESISTANT STEEL WITH IMPROVED FORMABILITY AND METHOD THEREOF

BACKGROUND OF THE INVENTION

The present invention relates to heat-resistant steels which exhibit high strength even at high temperatures of 700°–1150° C. and which also exhibit superior formability.

HK 40 steels (25 Cr-20 Ni Heat-Resistant Cast Steels) have been widely used in the chemical industry in high-temperature devices. For example, they have been used as tubes for cracking furnaces of ethylene-manufacturing plants and tubes for reforming furnaces for producing hydrogen gas. However, since such tubes are produced by centrifugal casting, it is rather difficult to manufacture small diameter tubes, thinwalled tubes, and lengthy tubes, and the resulting tubes suffer from poor ductility and toughness.

Alloy 800H (0.08 C-20 Cr-32 Ni-0.4 Ti-0.4 Al) has been known as a material for making forged tubing. However, this alloy does not have a satisfactory high-temperature strength.

Recently, cracking furnaces of ethylene plants are being operated at higher temperatures than in the past so as to increase the yields of the products. Therefore, the materials which constitute cracking furnaces must have greater high-temperature strength than in the past.

There are many new materials for use in centrifugally cast tubing which have a higher level of strength than HK 40 steels. Some examples of these alloys are HP, HP-Nb, HP-Nb,W, and BST. Forged tubing materials which correspond to these new alloys are nickel-based alloys such as Hastelloy X (0.06 -21 Cr-9 Mo-1 Co-bal. Ni), Inconel 617 (0.06 C-21 Cr-8.5 Mo-12 Co-1 Al-bal.Ni), and Inconel 625 (0.04 C-21 Cr-9 Mo-3.5 Nb-bal.Ni). However, since these Ni-based alloys contain a great amount of the very expensive elements Mo and Ni, these alloys have problems with respect to economy and formability.

In order to increase reaction efficiency and perform reactions under stable conditions in various high-temperature apparatuses, there is a need for a forged tubing material which has excellent high-temperature strength and which can be used to manufacture lengthy piping with a small diameter.

Materials for use in cracking furnaces and reforming furnaces must have high-temperature strength and a particularly high creep rupture strength, since such materials are used at extremely high temperatures of about 700°–1150° C. Therefore, a centrifugally cast tube has been used for such purposes because it exhibits satisfactory high-temperature strength and is economical.

However, it is difficult to manufacture a lengthy tube with a thin wall and a small diameter by centrifugal casting. Furthermore, centrifugally cast tubes have unsatisfactory ductility and toughness, although centrifugally cast tubes with a high carbon content (0.4–0.5%) have excellent creep rupture strength. This is because eutectic carbide precipitates along the grain boundaries.

In forged tubes with a high carbon content, such precipitated eutectic carbides are broken during working including forging and extrusion, resulting in a large amount of undissolved carbides remaining in the matrix without in any way improving the creep rupture strength. In other words, it is necessary to carry out a different type of strengthening for forged piping material, since the presence of these eutectic carbides cannot be used for strengthening.

In Japanese Unexamined Patent Application Disclosure No. 23050/1982, the inventors of the present invention proposed a heat-resistant forging steel in which high strength is achieved by utilizing grain boundary-strengthening elements as well as solid solution-strengthening elements. The proposed steel can exhibit greater high-temperature strength than forged tubing material such as Alloy 800H and centrifugally cast tubing material such as HK40. Its creep rupture strength is a maximum of 2.20 kgf/mm$^2$ at 1000° C. after 1000 hours, and in particular the strength is 1.70 kgf/mm$^2$ for the steel (0.27 C-0.52 Si-1.16 Mn-24.42 Cr-24.8 Ni-0.48 Ti-0.34 Al-0.0040 B-bal.Fe). In addition, it can also exhibit satisfactory toughness, and it can be used to produce long, thin-walled tubes with a small diameter. However, it is necessary to increase the content of Mo and W to further strengthen the steel, although the formability is degraded by increasing the content of these elements. Therefore, the Ni content must be increased to achieve a stabilized structure and as a result, the alloy is less economical. In the abovedescribed patent publication, there is no reference to the nitrogen content at all.

Japanese Unexamined Patent Application Disclosure No. 21922/1975 discloses steel compositions similar to those mentioned above. In this application, 0.005–0.05% of magnesium is added to further improve high-temperature properties, and there is no mention of the nitrogen content. The resulting creep rupture strength is only at most 4.6 kgf/mm$^2$ after $10^3$ hours and at most 3.0 kgf/mm$^2$ after $10^4$ hours at 900° C. Based on these data it is estimated that the creep rupture time at 1000° C. and 2 kgf/mm$^2$ is 391 hours (minimum)–2185 hours (maximum). In particular, the creep rupture time is 391 hours (minimum)–966 hours (maximum) for the steel (0.20 C-0.52 Si-1.1 Mn-22.8 Cr-25.1 Ni-0.53 Ti-0.56 Al-0.005 B-0.012 -Mg-bal. Fe).

SUMMARY OF THE INVENTION

An object of the present invention is to provide a high-strength, heat-resistant steel which has excellent formability and is economical.

Another object is to provide a steel with improved high-temperature strength in which expensive elements such as Mo, W, and Ni, which are required to stabilize the structure are added in lesser amounts than in the past.

Still another object of the present invention is to provide a high-strength, heat-resistant steel in which the amounts of impurities and grain size number are controlled so as to further improve high-temperature strength, ductility, and formability.

A further object of the present invention is to provide a high-strength, heat-resistant steel which has a creep rupture time of 2000 hours or more at 1000° C. and 2.0 kgf/mm$^2$, and which is less expensive but superior with respect to creep rupture elongation, and formability at high temperatures and room temperature.

In a broad sense, the present invention is a high-strength, heat-resistant steel with improved formability which consists essentially of, by weight %:

| | |
|---|---|
| C: 0.05–0.30%, | Si: not greater than 3.0%, |
| Mn: not greater than 10%, | Cr: 15–35%, |

-continued

| | |
|---|---|
| Ni: 15–50%, | Mg: 0.001–0.02%, |
| B: 0–0.01%, | Zr: 0–0.10%, |
| Ti 0–1.0%, | Nb: 0–2.0%, |
| Al: 0–1.0%, | |
| Mo: 0–3.0%, | W: 0–6.0%, |
| (Mo + ½ W = 3.0% or less) | |

Fe: balance with incidental impurities, oxygen and nitrogen as impurities being restricted to 50 ppm or less and 200 ppm or less, respectively, and the austenite grain size number being restricted to not greater than 4.

According to a preferred embodiment of the present invention, the steel comprises 0.001–0.01% of B and/or 0.001–0.10% of Zr together with at least one of 0.05–1.0% of Ti, 0.1–2.0% of Nb, and 0.05–1.0% of Al.

In another preferred embodiment of the present invention, the steel further comprises 0.5–3.0% of Mo and/or 0.5–6.0% (Mo+½ W=0.5–3.0%).

Thus, according to the present invention, the addition of Mo and W which are effective as strengthening elements is suppressed or restricted so as to improve formability and to make the steel economical while the content of impurities such as oxygen, and nitrogen is restricted to not greater than 50 ppm and 200 ppm, respectively, and the grain size number of austenite is restricted to not greater than 4 in order to give an excellent high-temperature strength at extremely high temperatures of about 700°–1150° C.

DESCRIPTION OF THE PREFERRED EMBODIMENTS

Figure 1:
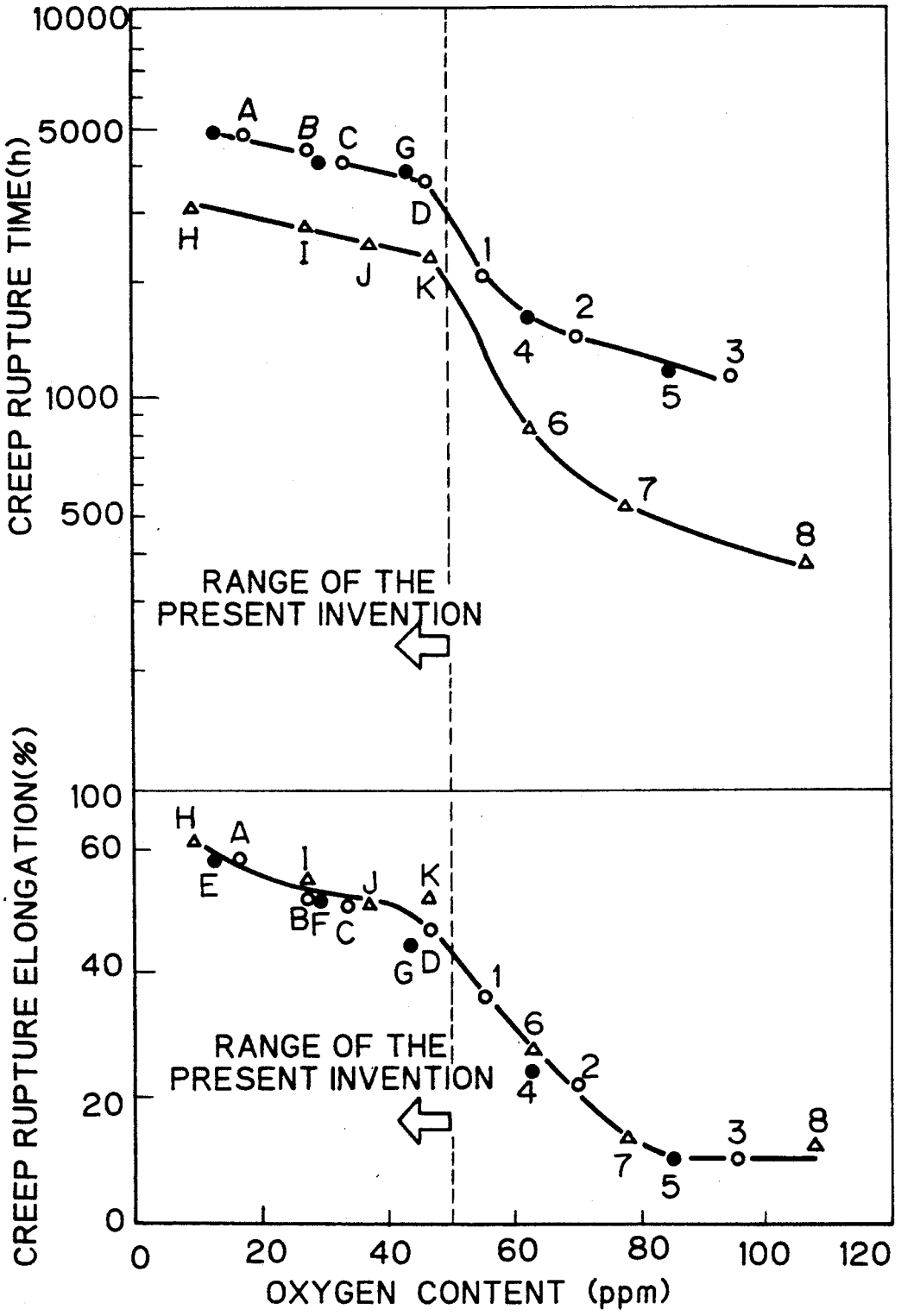
FIG. 1 is a graph showing the relationship between the oxygen content of steel and creep rupture time at 1000° C. and 2.0 kgf/mm$^2$ and rupture elongation.

The reasons for defining the steel composition as well as the austenite grain size number of the present invention as described above are as follows.

Carbon (C) is effective for increasing tensile strength as well as creep rupture strength to a level required for heat-resistant steels. In the present invention, it is necessary to incorporate 0.05% or more of carbon. However when the carbon content is over 0.30%, undissolved carbides remain even after solid solution heat treatment without in any way strengthening the steel, and the growth of grains is also suppressed. Therefore, the carbon content is restricted to 0.05–0.30%. Preferably, it is 0.08–0.27%, within which there are included two groups; C: 0.08–0.20%, and C: 0.15–0.27%.

Silicon (Si) is necessary as an deoxidizing element, and it is also effective for improving the resistance to oxidation and carburization. However when the Si content is over 3.0%, the formability as well as weldability and stabilization of structure are degraded. Therefore, according to the present invention, the Si content is restricted to not greater than 3.0%. In particular, when the resistance to carburization should be further improved, it is preferable that the Si content be 1% or more.

Manganese (Mn) is a deoxidizing element which is also effective for improving formability. Mn is an austenite-former, and Ni may be partially replaced by Mn. However, excess addition of Mn degrades formability, so the Mn content is restricted to 10.0% or less.

Chromium (Cr) is important for assuring the resistance to oxidation. For this purpose it is necessary to incorporate at least 15% of Cr, and preferably not less than 20%. In order to improve the resistance to oxidation and carburization, the higher the Cr content the better. However, when it is higher than 35%, formability as well as stabilization in structure are degraded. Thus, according to the present invention, the Cr content is restricted to 15–35%, and preferably to 20–30%. The most desirable range is 23–27%.

Nickel (Ni) is an austenite former which is added in an amount determined by considering the total amount of ferrite formers such as Cr, Si, Mo, and W so as to form a stable austenite phase. However, the addition of a large amount of Ni makes the resulting steel uneconomical. Thus, according to the present invention the Ni content is defined as 15–50% by weight. Preferably, the Ni content is 23–42%, within which there are included three groups; Ni: 23–27%, Ni: 30–40%, and Ni: 32–42%.

Titanium (Ti), niobium (Nb), and aluminum (Al) are effective for improving high-temperature strength, and particularly creep rupture strength. In order to be effective, it is necessary that Ti be added in an amount of 0.05% or more, Nb in an amount of 0.1% or more, and Al in an amount of 0.05% or more. However, when more than 1% of Ti or Al is added or more than 2.0% of Nb is added, there is no further improvement in high-temperature strength while formability as well as weldability are degraded. Therefore, the amounts of Ti, Nb, and Al are defined as 0.05–1.0%, 0.1–2.0%, and 0.05–1.0%, respectively. Any one of these elements can be added alone or in combination with one or two of the others.

Boron (B) and zirconium (Zr) are effective for strengthening grain boundaries. In particular, fracture is dominated (or mainly caused) by intergranular fracture in a high temperature range of about 700° C. and higher, and the addition of these elements is effective for supressing the occurrence of intergranular fracture. For this purpose it is desirable that any one of these elements be added in an amount of 0.001% or more each. However, the addition of an excess amount of any of these elements results in degradation in weldability, so the content of B is defined as 0.001–0.01%, and Zr as 0.001–0.10%. These elements can be added alone or in combination.

Magnesium (Mg) is effective for improving formability. It can also improve creep rupture strength. In order to improve such properties, it is necessary to add Mg in an amount of 0.001% or more. However, when Mg is added in an amount of higher than 0.02%, the creep rupture strength decreases again, so the Mg content is defined as 0.001–0.02%.

P and S are present as inevitable impurities. It is preferable that P be present in an amount of 0.015% or less and S in an amount of 0.003% or less.

In addition to these impurities, the restriction of the amounts of oxygen and nitrogen as impurities is crucial to the present invention. A decrease in the content of oxygen is extremely effective for improving creep rupture strength and creep rupture ductility. As shown in detail in the following examples, when the oxygen content is restricted to not greater than 50 ppm, the above-noted properties can be improved remarkably. It is thought on the basis of the observation of structure after fracture that intergranular fracture decreases drastically as the oxygen content decreases. It is hypothesized that this is because the grain boundaries are strengthened by a decrease in the oxygen content.

Usually nitrogen is contained in an amount of 250–400 ppm for this type of steel. However, according to the present invention, it was found that when the nitrogen content is reduced to 200 ppm or less, creep rupture strength as well as ductility are markedly improved. Because the steel of the present invention contains Ti, Nb, and Al as strengthening elements, the formation of nonmetallic inclusions is suppressed when the content of nitrogen is reduced to a lower level, and the amount of effective Ti, Nb, and Al is increased remarkably, resulting in further strengthening of steel. It is desirable that the nitrogen content be restricted to 150 ppm or less.

The above findings are unexpected because it has been thought that the addition of nitrogen would be effective for further improving high-temperature properties including creep properties when nitrogen is dissolved in steel or is precipitated as fine carbides.

Molybdenum (Mo) and tungsten (W) are optional elements which function as solid solution hardening elements and which are also effective for improving high-temperature strength. For this purpose it is necessary that at least one of these elements be added in an amount of 0.5% or more each. In order to improve high-temperature strength, the higher the content of these elements the better. However, the addition of these elements results in a degradation in formability, and it is also necessary to increase the Ni content so as to stabilize an austenite phase, making the resulting steel less economical. Thus, according to the present invention, the content of Mo is defined as 0.5–3.0% and W as 0.5–6.0%. When both are added, $Mo+\frac{1}{2}W$ is 0.5–3.0%.

When steels of this type are heated at 700° C. or higher, creep rupture is dominated by intergranular fracture. Thus, in order to increase the creep rupture strength, it is desirable that the austenite grain size be coarse. On the basis of a series of experiments, it was found that when the austenite grain size is defined as No. 4 or less (ASTM grain size number), a satisfactory level of high-temperature strength can be achieved for steel having a steel composition defined in the present invention.

The austenite grain size number can be adjusted by changing the solid solution treatment temperature, for example.

The present invention will now be further described in conjunction with working examples which are presented merely for illustrative purposes.

EXAMPLES

Chemical compositions of specimens used in this example are shown in Table 1, in which Steels A through T are the steels of the present invention, and Steels Nos. 1 through 18 are comparative ones. These steels were melted using a vacuum melting furnace with a capacity of 17 kg. After forging and cold rolling, solid solution treatment was performed. The solid solution treatment was carried out at a temperature at which the austenite grain size number became No. 4 or smaller numbers, i.e., coarser. For Steel A, the temperature was adjusted to achieve a grain size number of No. 4 or smaller or greater numbers. For the other steels the grain size number was set at smaller than No. 4, i.e., coarser.

The resulting specimens were subjected to a creep rupture test at 1000° C. at a load of 2.0 kgf/mm$^2$. The test results are shown in Table 2 and in FIG. 1. The symbols of FIG. 1 are the same as those in Table 2.

FIG. 1 is a graph showing the relationship of creep rupture strength and creep rupture elongation to the oxygen content for three types of steel compositions. As is apparent from FIG. 1, steels of the present invention having an oxygen content of 50 ppm or less exhibited a creep rupture time as well as creep rupture elongation which were markedly improved compared with those of the comparative steel which contained more than 50 ppm of oxygen. Such advantages as those achieved by decreasing the oxygen content are apparent from Table 2 for other types of steel of the present invention. See Steels L through R of the present invention and Comparative Steel Nos. 9 through 15.

In order to demonstrate the superiority of the present invention over prior art steel, the properties of the before-mentioned steel (0.20 C-0.52 Si-1.1 Mn-22.8 Cr-25.1 Ni-0.53 Ti-0.56 Al-0.005 B-0.012 Mg-bal.Fe) of Japanese Unexamined Patent Application Disclosure No. 21922/1975 were compared with those of Steel S of the present invention. As mentioned before, the rupture time of this prior art steel is estimated to be at most 966 hours at 1000° C. and 2.0 kgf/mm$^2$, and that of Steel S is 2423 hours. Thus, the creep properties of the steel of the present invention are clearly superior to those of the prior art steel.

As mentioned before, the creep rupture time of the conventional steel (0.27 C-0.52 Si-1.16 Mn-0.016 P-0.005 S-24.42 Cr-24.8 Ni-0.48 Ti-0.34 Al-0.0040 B-bal. Fe) of Japanese Unexamined Patent Application Disclosure No. 23050/1982 is said to be 1000 hours at 1000° C. and 1.7 kgf/mm$^2$. It is noted that Steel S of the present invention has a much superior creep rupture time even though the stress applied to Steel S is greater than that of this conventional steel by 0.5 kgf/mm$^2$. Thus, the creep properties of the steel of the present invention are clearly superior to those of this conventional steel as well.

Figure 2:
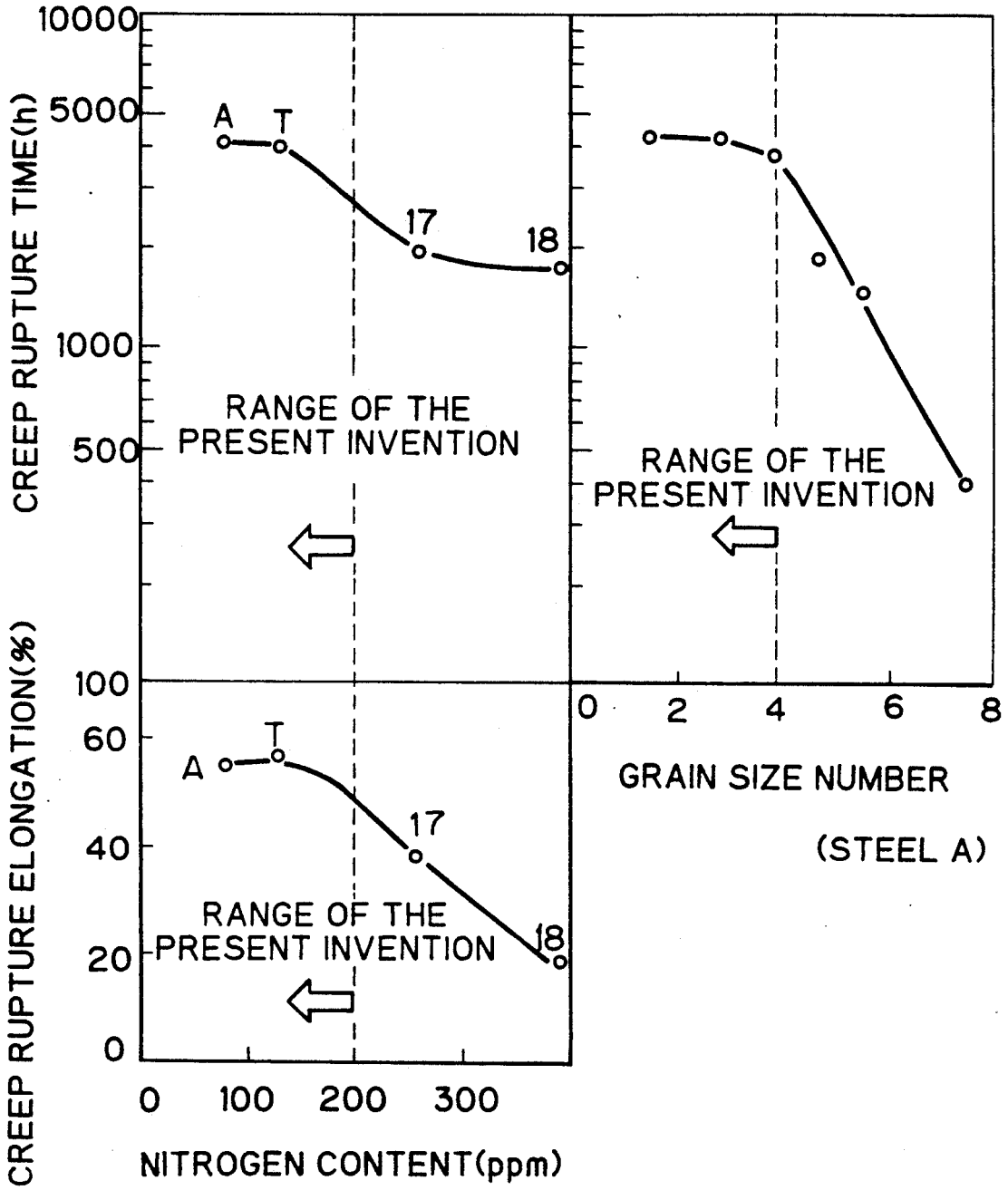
FIG. 2 is a graph showing the relationship of the nitrogen content and the grain size of steel to creep rupture time and rupture elongation under the same conditions as in FIG. 1.

FIG. 2 is a graph showing the relationship of the creep rupture strength and creep rupture elongation and the nitrogen content. FIG. 2 also indicates the relationship between the crystal grain size number and creep rupture time for Steel A.

It is apparent from FIG. 2 that when the nitrogen content is restricted to not greater than 200 ppm, creep rupture time as well as creep rupture elongation are markedly improved and that when the crystal grain size number is restricted to not larger than 4, creep rupture time is increased.

Figure 3:
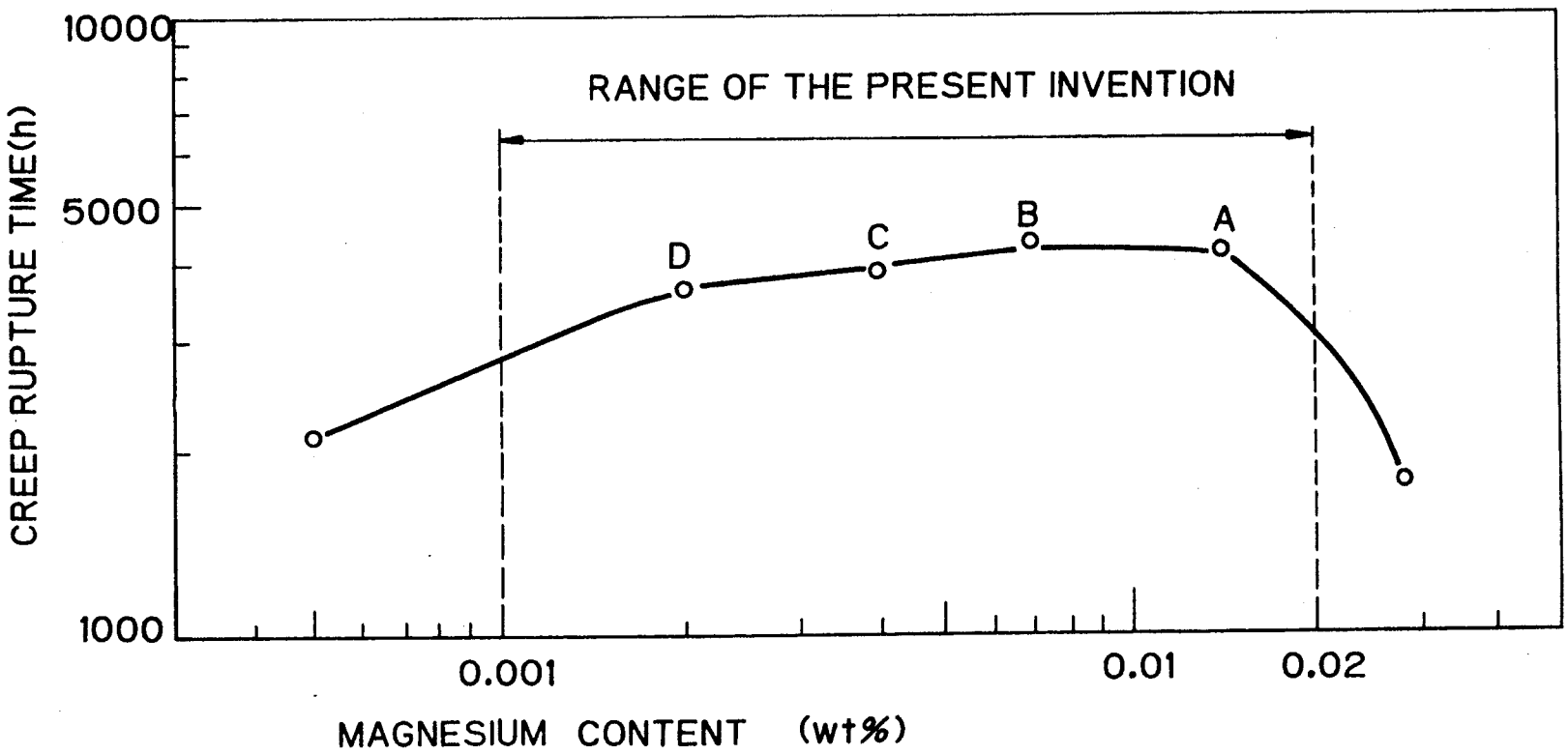
FIG. 3 is a graph showing the relationship between the Mg content of steel and the creep rupture time under the same conditions as in FIG. 1.

FIG. 3 shows the effectiveness of the addition of Mg at improving the creep rupture time. It is apparent from FIG. 3 that when the Mg content is 0.001% or more, the creep rupture life is improved. When the Mg content is over 0.02%, the life is decreased again. An effective range for the Mg content is therefore 0.001–0.02%.

Table 3 shows the results of tests which were carried out to evaluate formability under hot and cold conditions of steels of the present invention and comparative steels. Test pieces (diameter of 10 mm and length of 130 mm) were cut from 17 kg ingots manufactured by vacuum melting. These test pieces were subjected to the Gleeble test at 1200° C. at a strain rate of 5 s$^{-1}$. Cold workability was evaluated on the basis of the tensile rupture elongation during a tensile test carried out at room temperature for test pieces (diameter of 6 mm, gauge distance of 30 mm) obtained after cold rolling followed by solid solution treatment.

It is apparent from Table 3 that formability under hot conditions and cold conditions of the steel of the present invention is much improved compared with that for comparative steels.

While the invention has been described with reference to the foregoing embodiments, variations and modifications may be made thereto which fall within the scope of the appended claims.

TABLE 2

| Present Invention | | | Comparative | | |
|---|---|---|---|---|---|
| No. | Creep Rupture Time (h) | Creep Rupture Elongation (%) | No. | Creep Rupture Time (h) | Creep Rupture Elongation (%) |
| A | 4103 | 55 | 1 | 2054 | 36 |
| B | 4316 | 47 | 2 | 1421 | 23 |
| C | 3780 | 56 | 3 | 1114 | 11 |
| D | 3534 | 47 | | | |
| E | 4425 | 48 | 4 | 1597 | 25 |
| F | 3810 | 52 | 5 | 1135 | 10 |
| G | 3848 | 47 | | | |
| H | 2649 | 52 | 6 | 825 | 28 |
| I | 2578 | 55 | 7 | 519 | 14 |
| J | 2736 | 52 | 8 | 378 | 13 |
| K | 2263 | 53 | | | |
| L | 2435 | 56 | 9 | 437 | 15 |
| M | 1994 | 32 | 10 | 372 | 8 |
| N | 1850 | 63 | 11 | 3305 | 27 |
| O | 7135 | 44 | 12 | 3656 | 11 |
| P | 6977 | 37 | 13 | 3329 | 9 |
| Q | 4815 | 58 | 14 | 1674 | 18 |
| R | 5932 | 51 | 15 | 2496 | 28 |
| S | 2423 | 53 | 16 | 526 | 18 |
| T | 3950 | 57 | 17 | 1924 | 38 |
| | | | 18 | 1736 | 19 |

TABLE 1

| | No. | C | Si | Mn | Ni | Cr | Mo | W | Nb | Ti | Al | B | Zr | Mg | O | N | Grain Size Number |
|---|---|---|---|---|---|---|---|---|---|---|---|---|---|---|---|---|---|
| Present Invention | A | 0.14 | 1.75 | 1.03 | 38.5 | 24.7 | 1.48 | — | — | 0.42 | — | 0.0026 | 0.028 | 0.014 | 0.0018 | 0.008 | 2.8 |
| | B | 0.15 | 1.73 | 0.98 | 38.7 | 24.5 | 1.51 | — | — | 0.40 | — | 0.0026 | 0.030 | 0.007 | 0.0028 | 0.007 | 2.6 |
| | C | 0.14 | 1.73 | 1.00 | 37.9 | 24.7 | 1.50 | — | — | 0.40 | — | 0.0029 | 0.031 | 0.004 | 0.0034 | 0.007 | 2.8 |
| | D | 0.14 | 1.70 | 1.12 | 38.0 | 24.4 | 1.48 | — | — | 0.40 | — | 0.0025 | 0.029 | 0.002 | 0.0047 | 0.006 | 2.5 |
| | E | 0.18 | 1.50 | 1.50 | 35.2 | 24.5 | — | 1.70 | — | 0.40 | — | 0.0035 | 0.032 | 0.005 | 0.0013 | 0.008 | 3.4 |
| | F | 0.19 | 1.48 | 1.50 | 34.8 | 24.8 | — | 1.75 | — | 0.39 | — | 0.0020 | 0.030 | 0.005 | 0.0030 | 0.009 | 3.5 |
| | G | 0.18 | 1.50 | 1.56 | 35.2 | 24.6 | — | 1.73 | — | 0.41 | — | 0.0025 | 0.024 | 0.008 | 0.0044 | 0.006 | 3.4 |
| | H | 0.13 | 1.95 | 0.67 | 35.2 | 23.1 | — | — | — | 0.69 | — | 0.0025 | 0.040 | 0.010 | 0.0010 | 0.008 | 2.0 |
| | I | 0.13 | 2.04 | 0.58 | 36.0 | 22.9 | — | — | — | 0.72 | — | 0.0018 | 0.045 | 0.012 | 0.0028 | 0.008 | 2.3 |
| | J | 0.12 | 2.14 | 0.55 | 35.4 | 22.7 | — | — | — | 0.71 | — | 0.0024 | 0.039 | 0.009 | 0.0038 | 0.009 | 2.0 |
| | K | 0.13 | 1.98 | 0.66 | 35.4 | 23.0 | — | — | — | 0.74 | — | 0.0024 | 0.045 | 0.009 | 0.0047 | 0.007 | 2.5 |
| | L | 0.28 | 1.12 | 1.68 | 20.6 | 20.2 | — | — | — | 0.52 | — | 0.0061 | 0.004 | 0.007 | 0.0031 | 0.007 | 3.6 |
| | M | 0.20 | 2.41 | 0.50 | 25.3 | 17.2 | — | — | 1.36 | — | — | — | 0.058 | 0.013 | 0.0026 | 0.005 | 2.7 |
| | N | 0.07 | 1.74 | 7.86 | 48.7 | 33.0 | 0.62 | 0.56 | 0.13 | 0.07 | — | 0.0014 | 0.016 | 0.003 | 0.0020 | 0.007 | 1.7 |
| | O | 0.14 | 1.96 | 1.16 | 48.5 | 18.3 | — | 5.29 | — | 0.14 | — | — | 0.029 | 0.006 | 0.0019 | 0.008 | 3.7 |
| | P | 0.18 | 0.57 | 1.10 | 39.7 | 23.1 | 2.78 | — | — | 0.27 | — | 0.0087 | — | 0.010 | 0.0010 | 0.008 | 3.5 |
| | Q | 0.14 | 1.81 | 1.51 | 41.3 | 27.8 | 1.14 | — | — | 0.90 | — | — | 0.092 | 0.007 | 0.0014 | 0.006 | 2.5 |
| | R | 0.15 | 1.80 | 1.50 | 37.5 | 20.3 | 0.58 | 3.20 | 0.38 | 0.19 | — | 0.0020 | 0.024 | 0.015 | 0.0031 | 0.008 | 3.0 |
| | S | 0.23 | 0.69 | 1.43 | 25.2 | 24.9 | — | — | — | 0.54 | 0.61 | 0.0053 | — | 0.008 | 0.0023 | 0.007 | 2.8 |
| | T | 0.14 | 1.76 | 1.10 | 38.8 | 25.0 | 1.50 | — | — | 0.43 | — | 0.0028 | 0.030 | 0.013 | 0.0020 | 0.013 | 2.7 |
| Comparative | 1 | 0.15 | 1.74 | 1.00 | 38.71 | 24.5 | 1.52 | — | — | 0.42 | — | 0.0028 | 0.031 | 0.008 | 0.0056 | 0.007 | 2.5 |
| | 2 | 0.14 | 1.70 | 1.14 | 39.21 | 25.0 | 1.60 | — | — | 0.44 | — | 0.0030 | 0.026 | 0.008 | 0.0070 | 0.008 | 2.8 |
| | 3 | 0.14 | 1.74 | 1.14 | 38.6 | 25.1 | 1.61 | — | — | 0.40 | — | 0.0031 | 0.030 | 0.009 | 0.0095 | 0.009 | 2.7 |
| | 4 | 0.18 | 1.48 | 1.45 | 35.5 | 24.7 | — | 1.76 | — | 0.39 | — | 0.0040 | 0.030 | 0.007 | 0.0063 | 0.009 | 3.7 |
| | 5 | 0.19 | 1.39 | 1.58 | 34.8 | 25.0 | — | 1.89 | — | 0.43 | — | 0.0051 | 0.021 | 0.006 | 0.0085 | 0.008 | 3.4 |
| | 6 | 0.13 | 1.91 | 0.71 | 34.9 | 23.2 | — | — | — | 0.67 | — | 0.0029 | 0.045 | 0.012 | 0.0063 | 0.006 | 2.1 |
| | 7 | 0.13 | 2.01 | 0.61 | 35.4 | 22.4 | — | — | — | 0.70 | — | 0.0041 | 0.018 | 0.006 | 0.0078 | 0.006 | 2.0 |
| | 8 | 0.13 | 2.01 | 0.56 | 35.0 | 23.1 | — | — | — | 0.71 | — | 0.0034 | 0.028 | 0.009 | 0.0107 | 0.007 | 2.1 |
| | 9 | 0.27 | 1.07 | 1.70 | 20.4 | 19.8 | — | — | — | 0.55 | — | 0.0064 | 0.007 | 0.007 | 0.0086 | 0.008 | 3.4 |
| | 10 | 0.21 | 2.50 | 0.48 | 25.0 | 17.5 | — | — | 1.50 | — | — | — | 0.060 | 0.010 | 0.0073 | 0.008 | 2.8 |
| | 11 | 0.07 | 1.68 | 7.41 | 48.0 | 32.5 | 0.65 | 0.61 | 0.15 | 0.06 | — | 0.0018 | 0.020 | 0.005 | 0.0103 | 0.008 | 1.5 |
| | 12 | 0.16 | 2.10 | 1.00 | 49.6 | 18.8 | — | 5.68 | — | 0.16 | — | — | 0.032 | 0.008 | 0.0070 | 0.006 | 3.8 |
| | 13 | 0.18 | 0.50 | 1.26 | 38.0 | 22.9 | 2.63 | — | — | 0.31 | — | 0.0079 | — | 0.009 | 0.0075 | 0.006 | 3.4 |
| | 14 | 0.13 | 1.78 | 1.51 | 40.8 | 27.4 | 1.24 | — | — | 0.85 | — | — | 0.83 | 0.007 | 0.0082 | 0.007 | 2.3 |
| | 15 | 0.15 | 1.86 | 1.38 | 37.2 | 19.8 | 0.63 | 3.17 | 0.40 | 0.17 | — | 0.0023 | 0.032 | 0.010 | 0.0061 | 0.006 | 3.0 |
| | 16 | 0.24 | 0.70 | 1.39 | 25.4 | 25.0 | — | — | — | 0.55 | 0.59 | 0.0055 | — | 0.009 | 0.0078 | 0.007 | 2.6 |
| | 17 | 0.14 | 1.74 | 1.05 | 38.7 | 24.8 | 1.48 | — | — | 0.43 | — | 0.0027 | 0.029 | 0.013 | 0.0020 | 0.026 | 2.8 |
| | 18 | 0.14 | 1.76 | 1.10 | 39.0 | 25.0 | 1.50 | — | — | 0.44 | — | 0.0030 | 0.030 | 0.010 | 0.0018 | 0.039 | 2.5 |

| | No. | Hot Workability Elongation by Gleeble Test at 1200° C. (%) | Cold Workability Elongation by Tensile Test at Room Temperature (%) |
|---|---|---|---|
| Present Invention | A | 70 | 55 |
| | F | 72 | 58 |
| | H | 76 | 63 |
| Comparative | 1 | 40 | 40 |
| | 18 | 44 | 32 |
| | 4 | 46 | 36 |
| | 6 | 52 | 45 |

What is claimed is:

1. A high-strength, heat-resistant steel with improved formability which consists essentially of, by weight %:

C: 0.15–0.30%, Si: not greater than 3.0%
Mn: not greater than 10%, Cr: 15–35%,

-continued

| | |
|---|---|
| Ni: 15-50%, | Mg: 0.001-0.02%, |
| B: 0.001-0.01% and/or | Zr: 0.001-0.10%, |
| at least one of Ti: 0.05-1.0%, | Nb: 0.1-2.0%, and |
| | Al: 0.05-1.0%, |
| Mo: 0-3.0%, | W: 0-6.0%, |
| (Mo + ½ W = 3.0% or less) | |

a balance of Fe and incidental impurities, of the impurities, oxygen and nitrogen being restricted to 50 ppm or less and 200 ppm or less, respectively, and the austenite grain size number being restricted to not greater than 4.

2. A high-strength, heat-resistant steel with improved formability as set forth in claim 1, wherein the nitrogen content is 150 ppm or less.

3. A high-strength, heat-resistant steel with improved formability as set forth in claim 1, wherein the Cr content is 20-30%.

4. A high-strength, heat-resistant steel with improved formability as set forth in claim 1, wherein the C content is 0.08-0.27%, the Cr content is 20-30%, and the Ni content is 23-42%.

5. A high-strength, heat-resistant steel with improved formability which consists essentially of, by weight %,:

| | |
|---|---|
| C: 0.05-0.30%, | Si: not greater than 3.0% |
| Mn: not greater than 10%, | Cr: 15-35%, |
| Ni: 15-50%, | Mg: 0.001-0.02%, |
| B: 0.001-00.01% and/or | Zr: 0.001-0.10%, |
| at least one of Ti: 0.05-1.0%, Nb: 0.1-2.0%, and Al: 0.05-1.0%, | |

a balance of Fe and incidental impurities, of the impurities, oxygen and nitrogen being restricted to 50 ppm or less and 200 ppm or less, respectively, and the austenite grain size number being restricted to not greater than 4.

6. A high-strength, heat-resistant steel with improved formability as set forth in claim 5, wherein C: 0.15-0.27%,
Cr: 23-27%,
Ni: 23-27%, and
Ti: 0.05-1.0%.

7. A high-strength, heat-resistant steel with improved formability as set forth in claim 5, wherein C: 0.15-0.27%,
Cr: 23-27%,
Ni: 23-27%,
Ti: 0.05-1.0%, and
Nb: 0.1-2.0% and/or Al: 0.05-1.0%.

8. A high-strength, heat-resistant steel with improved formability as set forth in claim 5, wherein C: 0.08-0.20%,
Si: 1.0-3.0%,
Cr: 23-27%,
Ni: 30-40%, and
Ti: 0.05-1.0%.

9. A high-strength, heat-resistant steel with improved formability as set forth in claim 5, wherein C: 0.08-0.20%,
Si: 1.0-3.0%,
Cr: 23-27%,
Ni: 30-40%,
Ti: 0.05-1.0%, and
Nb: 0.1-2.0% and/or Al: 0.05-1.0%.

10. A high-strength, heat-resistant steel with improved formability which consists essentially of, by weight %,:

| | |
|---|---|
| C: 0.05-0.30%, | Si: not greater than 3.0%, |
| Mn: not greater than 10%, | Cr: 15-35%, |
| Ni: 15-50%, | Mg: 0.001-0.02%, |
| B: 0.001-0.01% and/or | Zr: 0.001-0.10%, |
| at least one of Ti: 0.05-1.0%, Nb: 0.1-2.0%, and Al: 0.05-1.0%, | |
| Mo: 0.05-3.0% and/or | W: 0.5-6.0%, |
| (Mo + ½ W = 0.5-3.0%) | |

a balance of Fe and incidental impurities, of the impurities, oxygen and nitrogen being restricted to 50 ppm or less and 200 ppm or less, respectively, and the austenite grain size number being restricted to not greater than 4.

11. A high-strength, heat-resistant steel with improved formability as set forth in claim 10, wherein C: 0.08-0.20%,
Si: 1.0-3.0%,
Cr: 23-27%,
Ni: 32-42%, and
Ti: 0.05-1.0%.

12. A high-strength, heat-resistant steel with improved formability as set forth in claim 10, wherein C: 0.08-0.20%,
Si: 1.0-3.0%,
Cr: 23-27%,
Ni: 32-42%,
Ti: 0.05-1.0%, and
Nb: 0.1-2.0% and/or Al: 0.05-1.0%.

13. A method of improving formability as well as high temperature strength in the temperature range of 700°-1150° C. by adjusting the composition of steel such that the content of oxygen and nitrogen as impurities is 50 ppm or less and 200 ppm or less, respectively, and the austenite grain size number (ASTM) is not greater than 4, the steel consisting essentially of, by weight %:

| | |
|---|---|
| C: 0.05-0.30% | Si: not greater than 3.0% |
| Mn: not greater than 10%, | Cr: 15-35%, |
| Ni: 15-50%, | Mg: 0.001-0.02%, |
| B: 0.001 -0.01% and/or | Zr: 0.001-0.10%, |
| at least one of Ti: 0.05-1.0%, Nb: 0.1-2.0%, and Al: 0.05-1.0%, | |
| Mo: 0-3.0%, | W: 0-6.0%, |
| (Mo + ½ W = 3.0% or less) | |

a balance of Fe and incidental impurities, of the impurities, oxygen and nitrogen being restricted to 50 ppm or less and 200 ppm or less, respectively, and the austenite grain size number being restricted to not greater than 4.

14. The method of claim 13, wherein the nitrogen content is 150 ppm or less.

15. The method of claim 13, wherein the Cr content is 20-30%.

16. The method of claim 13, wherein the C content is 0.08-0.27%, the Cr content is 20-30%, and the Ni content is 23-42%.

17. A method of improving formability as well as high temperature strength in the temperature range of 700°-1150° C. by adjusting the composition of steel such that the content of oxygen and nitrogen as impurities is 50 ppm or less and 200 ppm less, respectively, and the austenite grain size number (ASTM) is not greater than 4, the steel consisting essentially of, by weight %:

| | |
|---|---|
| C: 0.05-0.30% | Si: not greater than 3.0% |
| Mn: not greater than 10%, | Cr: 15-35%, |
| Ni: 15-50%, | Mg: 0.001-0.02%, |
| B: 0.001-0.01% and/or | Zr: 0.001-0.10%, |
| at least one of Ti: 0.05-1.0%, Nb: 0.1-2.0%, and Al: 0.05-1.0%, | |

a balance of Fe and incidental impurities, of the impurities, oxygen and nitrogen being restricted to 50 ppm or less and 200 ppm or less, respectively, and the austenite grain size number being restricted to not greater than 4.

18. The method of claim 17, wherein the nitrogen content is 150 ppm or less.

19. The method of claim 17, wherein the Cr content is 20–30%.

20. The method of claim 17, wherein the C content is 0.08–0.27%, the Cr content is 20–30%, and the Ni content is 23–42%.

21. The method of claim 17, wherein the C content is 0.15–0.27%, the Cr content is 23–27%, and the Ni content is 23–27%.

22. The method of claim 17, wherein the C content is 0.08–0.20%, the Si content is 1.0–3.0%, the Cr content is 23–27%, and the Ni content is 30–40%.

23. A method of improving formability as well as high temperature strength in the temperature range of 700°-1150° C. by adjusting the composition of steel such that the content of oxygen and nitrogen as impurities is 50 ppm or less and 200 ppm or less, respectively, and the austenite grain size number (ASTM) is not greater than 4, the steel consisting essentially of, by weight %:

| | |
|---|---|
| C: 0.05–0.30% | Si: not greater than 3.0% |
| Mn: not greater than 10%, | Cr: 15–35%, |
| Ni: 15–50%, | Mg: 0.001–0.02%, |
| B : 0.001–0.01% and/or | Zr: 0.001–0.10%, |
| at least one of Ti: 0.05–1.0%, Nb: 0.1–2.0, and Al: 0.05–1.0%, | |
| Mo: 0.5–3.0% and/or | W: 0.5–6.0%, |
| (Mo + ½ W = 0.5–3.0%) | |

a balance of Fe and incidental impurities, of the impurities, oxygen and nitrogen being restricted to 50 ppm or less and 200 ppm or less, respectively, and the austenite grain size number being restricted to not greater than 4.

24. The method of claim 23, wherein the nitrogen content is 150 ppm or less.

25. The method of claim 23, wherein the Cr content is 20–30%.

26. The method of claim 23, wherein the C content is 0.08–0.27%, the Cr content is 20–30%, and the Ni content is 23–42%.

27. The method of claim 23, wherein the C content is 0.08–0.20%, the Si content is 1.0–3.0%, the Cr content is 23–27%, and the Ni content is 32–42%.

* * * * *